US005921425A

United States Patent [19]

Markey

[11] Patent Number: 5,921,425

[45] Date of Patent: Jul. 13, 1999

[54] CONTAINER CAP WITH SPRING LOADED COVER

[76] Inventor: Victor S. Markey, 1711 Mossbrook Ave., San Jose, Calif. 95130

[21] Appl. No.: 08/799,381

[22] Filed: Jul. 2, 1997

[51] Int. Cl.[6] ..... B65D 51/18

[52] U.S. Cl. ..... 220/254; 220/264; 220/810; 220/820; 215/236; 222/505

[58] Field of Search ..... 220/254, 262–264, 220/331, 336, 715, 810, 820, 827, 830; 215/236; 222/505

[56] References Cited

U.S. PATENT DOCUMENTS

| | | | |
|---|---|---|---|
| 1,152,286 | 8/1915 | Brownson | 220/336 |
| 1,264,029 | 4/1918 | Du Guay | 222/505 X |
| 1,282,679 | 10/1918 | Druskin | 222/505 X |
| 1,523,122 | 1/1925 | Hellmann | 222/505 X |
| 1,598,055 | 8/1926 | Compton | 222/505 X |
| 1,796,122 | 3/1931 | Ringenberg | 222/505 |
| 1,993,493 | 3/1935 | Vanderveld | 222/505 |
| 2,018,050 | 10/1935 | Bentley | 222/505 |
| 2,152,225 | 3/1939 | Thorn | 222/505 |
| 2,187,927 | 1/1940 | Ayotte | 222/505 X |
| 2,582,109 | 1/1952 | De Vee | 220/254 X |
| 3,915,333 | 10/1975 | Peyser et al. | 220/331 X |
| 3,938,690 | 2/1976 | Butler | 220/254 X |
| 4,077,538 | 3/1978 | Waterbury | 220/331 X |
| 4,561,563 | 12/1985 | Woods | 220/336 X |
| 5,435,358 | 7/1995 | Kempka et al. | 220/DIG. 33 X |

FOREIGN PATENT DOCUMENTS

| | | | |
|---|---|---|---|
| 650063 | 7/1964 | France | 215/236 |
| 261515 | 11/1926 | Italy | 220/336 |

*Primary Examiner*—Stephen K. Cronin
*Assistant Examiner*—Robin A. Hylton

[57] ABSTRACT

A new container cap for safely dispensing material from a container, especially cleanser containers. The device includes a circular cap member having an apertured top wall and a cylindrical collar adapted to engage with the top of a container, a pivoting disk attached to the top wall for pivoting movement to selectively cover and uncover the aperture(s) in the top wall, and a finger actuated, spring biased tab connected to the disk to cause pivoting movement of the disk between the covered and uncovered positions. A cylindrical containment tube extends from the top wall inside the cap member which seals with the top of the container. The material within the container thus flows entirely through the containment tube to the aperture(s), before being dispensed from the cap.

5 Claims, 4 Drawing Sheets

CONTAINER CAP WITH SPRING LOADED COVER

BACKGROUND OF THE INVENTION

1. Field of the Invention

The present invention relates to closure caps and more particularly pertains to a new container cap for safely dispensing material from a container, especially a cleanser container.

2. Description of the Prior Art

The use of closure caps is known in the prior art. More specifically, closure caps heretofore devised and utilized are known to consist basically of familiar, expected and obvious structural configurations, notwithstanding the myriad of designs encompassed by the crowded prior art which have been developed for the fulfillment of countless objectives and requirements.

Known prior art closure caps include U.S. Pat. No. 5,417,350; U.S. Pat. No. 4,805,790; U.S. Pat. No. 4,494,672; U.S. Pat. No. 4,207,982; U.S. Des. Pat. No. 354,200 and U.S. Des. Pat. No. 359,448.

While these devices fulfill their respective, particular objectives and requirements, the aforementioned patents do not disclose a new container cap. The inventive device includes a circular cap member having an apertured top wall and a cylindrical collar adapted to engage with the top of a container, a pivoting disk attached to the top wall for pivoting movement to selectively cover and uncover the aperture(s) in the top wall, and a finger actuated, spring biased tab connected to the disk to cause pivoting movement of the disk between the covered and uncovered positions.

In these respects, the container cap according to the present invention substantially departs from the conventional concepts and designs of the prior art, and in so doing provides an apparatus primarily developed for the purpose of safely dispensing material from a container, especially a cleanser container.

SUMMARY OF THE INVENTION

In view of the foregoing disadvantages inherent in the known types of closure caps now present in the prior art, the present invention provides a new container cap construction wherein the same can be utilized for safely dispensing material from a container, especially cleanser containers.

The general purpose of the present invention, which will be described subsequently in greater detail, is to provide a new container cap apparatus and method which has many of the advantages of the closure caps mentioned heretofore and many novel features that result in a new container cap which is not anticipated, rendered obvious, suggested, or even implied by any of the prior art closure caps, either alone or in any combination thereof.

To attain this, the present invention generally comprises a circular cap member having an apertured top wall and a cylindrical collar adapted to engage with the top of a container, a pivoting disk attached to the top wall for pivoting movement to selectively cover and uncover the aperture(s) in the top wall, and a finger actuated, spring biased tab connected to the disk to cause pivoting movement of the disk between the covered and uncovered positions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new container cap apparatus and method which has many of the advantages of the closure caps mentioned heretofore and many novel features that result in a new container cap which is not anticipated, rendered obvious, suggested, or even implied by any of the prior art closure caps, either alone or in any combination thereof.

It is another object of the present invention to provide a new container cap which may be easily and efficiently manufactured and marketed.

It is a further object of the present invention to provide a new container cap which is of a durable and reliable construction.

An even further object of the present invention is to provide a new container cap which is susceptible of a low cost of manufacture with regard to both materials and labor, and which accordingly is then susceptible of low prices of sale to the consuming public, thereby making such container cap economically available to the buying public.

Still yet another object of the present invention is to provide a new container cap which provides in the apparatuses and methods of the prior art some of the advantages thereof, while simultaneously overcoming some of the disadvantages normally associated therewith.

Still another object of the present invention is to provide a new container cap for safely dispensing material from a container, especially a cleanser container.

Yet another object of the present invention is to provide a new container cap which includes a circular cap member having an apertured top wall and a cylindrical collar adapted to engage with the top of a container, a pivoting disk attached to the top wall for pivoting movement to selectively cover and uncover the aperture(s) in the top wall, and a finger actuated, spring biased tab connected to the disk to cause pivoting movement of the disk between the covered and uncovered positions.

Still yet another object of the present invention is to provide a new container cap that prevents leakage of hazardous materials from the container.

Even still another object of the present invention is to provide a new container cap that protects a person using the container from the harmful effects of the material within the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
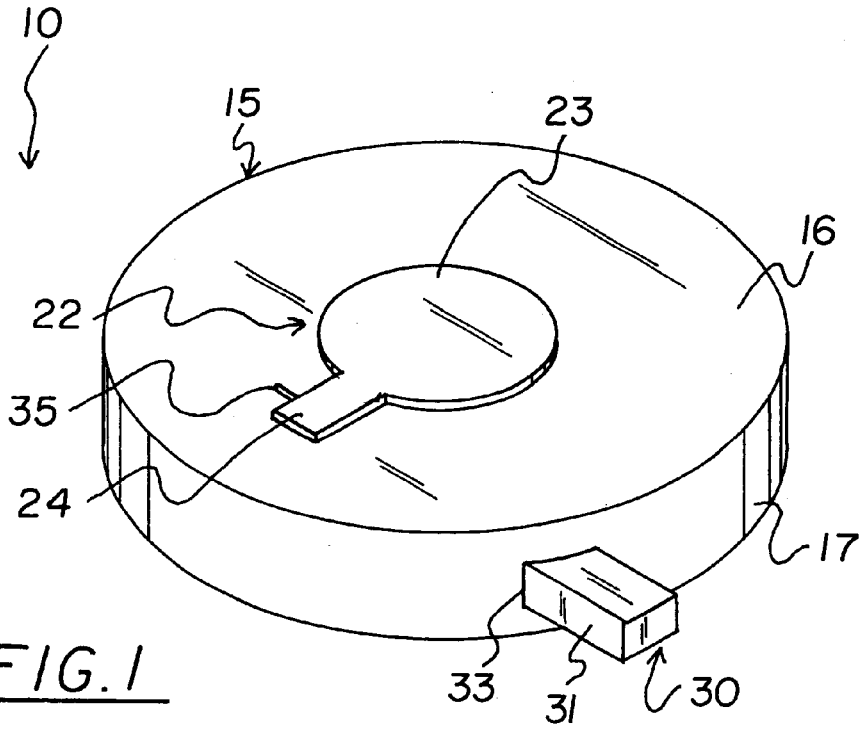
FIG. 1 is a perspective view of a new container cap according to the present invention.
Figure 2:
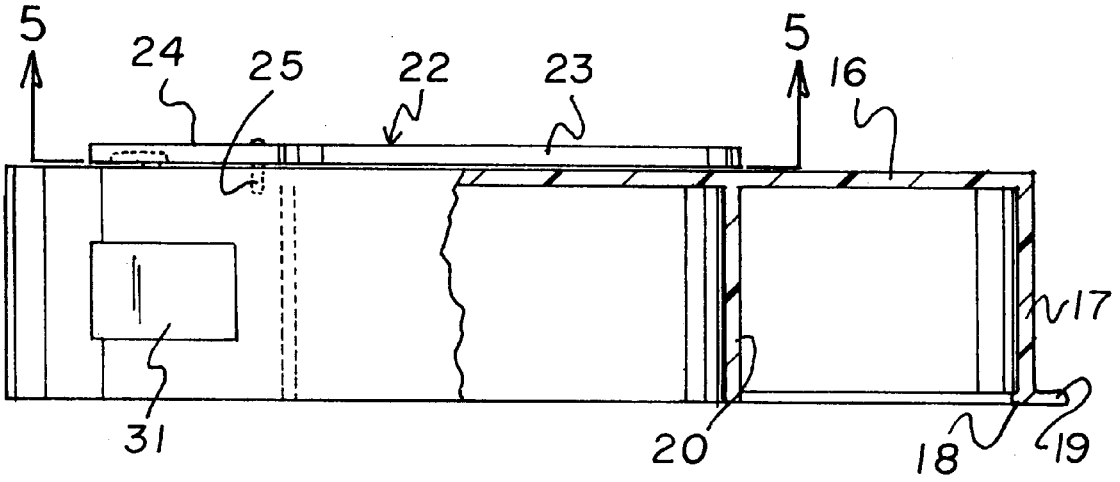
FIG. 2 is a side view of the cap with a portion broken away for illustration.

With reference now to the drawings, and in particular to FIGS. 1 through 8 thereof, a new container cap embodying the principles and concepts of the present invention and generally designated by the reference numerals 10, 10*a* will be described. The caps 10, 10*a* are intended for use with cylindrical containers having a generally flat top surface with a plurality of apertures through the top surface to permit material to be dispensed from the container, such as are typically found on containers for powdered cleanser.

More specifically, referring to FIGS. 1–7, it will be noted that the container cap 10 comprises a cap member 15 having a planar, circular top wall 16 and a slightly flexible, cylindrical collar 17 extending from the top wall. The collar 17 includes a ridge 18 formed at the free end thereof which permits the cap 10 to be attached to the top of a container (not shown). Note that the inner diameter of the ridge 18 should be slightly less than the outer diameter of the container, such that the collar is slightly deformed when the ridge is fitted over the end of the container to snugly secure the cap to the container. The collar 17 also includes a tab 19 projecting radially outward from the end of the collar which is engaged by a persons finger(s) to facilitate attachment/detachment of the cap from the container.

As best illustrated in FIGS. 1 through 4, it is seen that the cap member 15 includes a cylindrical tube 20 extending from the top wall 16 in the same direction as the collar 17 and parallel thereto. The tube 20 is connected at one end to the top wall and extends a distance substantially equal to the length of the collar. The tube 20 is made of a material which is more resilient than the material of the rest of the cap member 15 to permit the tube to deform and seal with the top of the container when the cap is mounted thereon, thus preventing leakage of hazardous material, such as cleanser, to areas outside of the tube. When the cap 10 is attached to the container, the tube 20 should surround the aperture(s) in the top of the container, such that the material within the container flows entirely into and through the tube.

Figure 4:
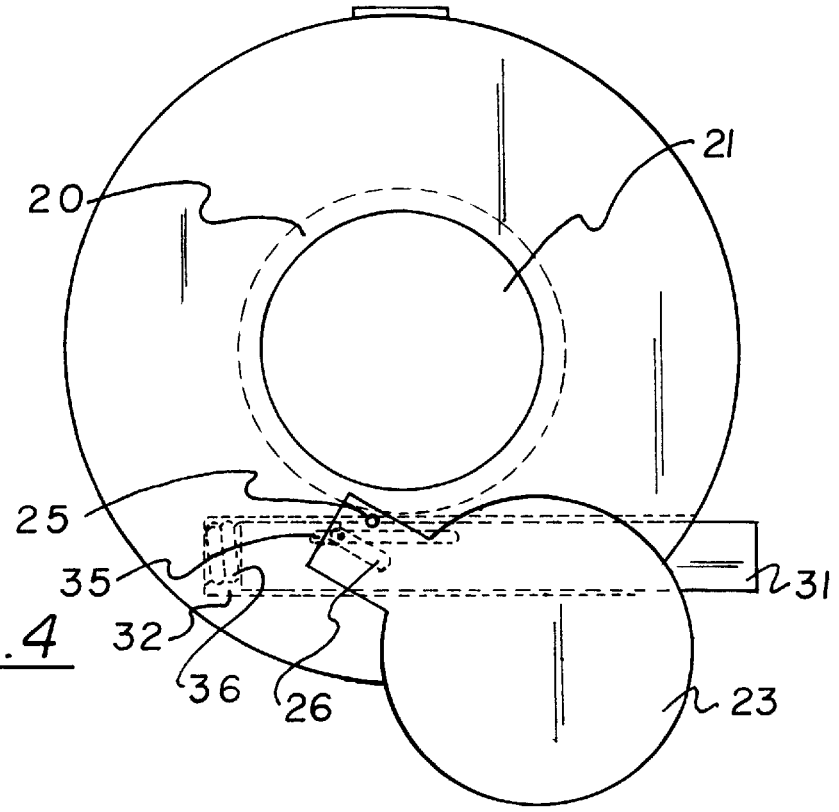
FIG. 4 is a view similar to FIG. 3, but with the disk in an non-cover position.
Figure 5:
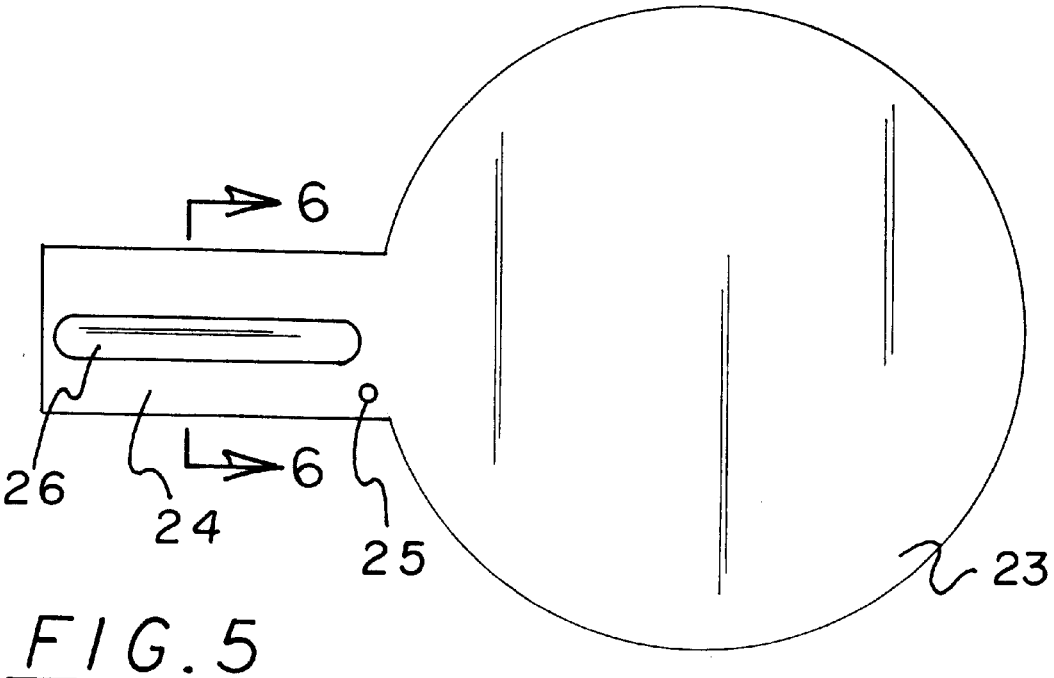
FIG. 5 is a view taken along line 5—5 of FIG. 2.
Figure 6:
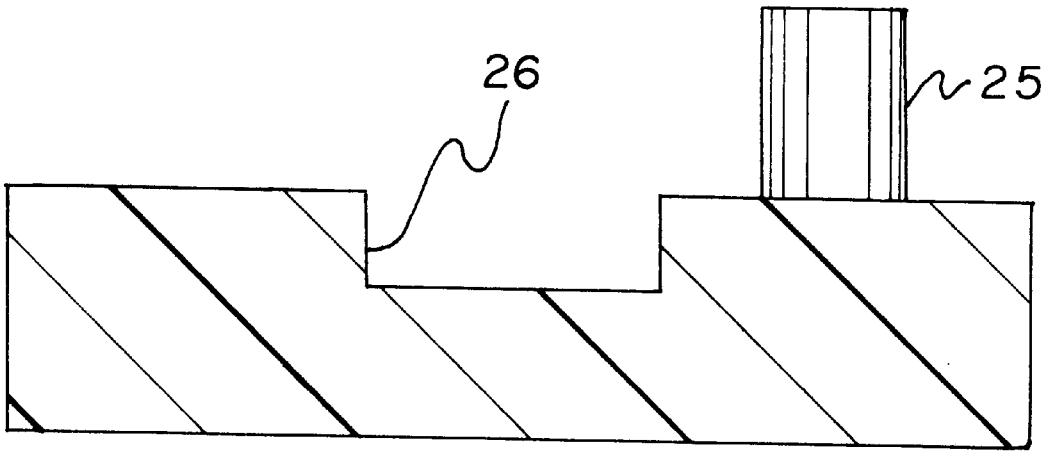
FIG. 6 is a cross sectional view taken along line 6—6 of FIG. 5.

As illustrated in FIG. 4, the top wall 16 includes a single, relatively large dispensing hole 21 through which the material to be dispensed exits after flowing through the tube 20. The diameter of the hole 21 is less than the diameter of the tube 20, and the hole is centered within the diameter of the tube.

Planar disk member 22 is pivotally attached to the top wall 16 on the outside thereof for selectively covering and uncovering the hole 21. The disk member 22 includes a substantially circular door 23 and an arm 24 extending radially from the door. The door 23 has a diameter greater than the diameter of the hole 21, but less than the diameter of the tube 20, such that the door 23 entirely blocks the hole 21 when disposed thereover. The arm 24 includes a pivot shaft 25 extending from its bottom surface which engages within an appropriately shaped recess in the top wall so as to permit pivoting movement of the disk member 22 about the axis of the pivot shaft. The arm 24 also includes a track 26 formed in its bottom surface which engages with an actuating means 30 to be later described. The track 26 extends generally radially with respect to the door 23, parallel to the longitudinal axis of the arm 24.

The above mentioned actuating means 30 comprises a rectangular actuating tab 31 which is slidably disposed within a correspondingly shaped housing 32 (shown in dashed lines) formed inside of the cap member 15 between the collar 17 and the tube 20, and disposed generally beneath the arm 24. One end of the tab 31 extends out through an aperture 33 in the collar 17, while the other end remains within the housing 32. A projection 34 extends from the top surface of the tab 31 and through a linear slot 35 (shown in dashed lines in FIGS. 3 and 4) formed in the top wall 16. The projection 34 extends into the track 26 for movement between the ends of the track when the actuating tab 31 is pressed inward. The disk member 22 is thus caused to pivot about the pivot shaft 25, thus uncovering the hole 21. A coil spring 36 is disposed within the housing 32 and engages with the end of the tab 31 to bias the tab outward, which also biases the disk member 22 to a covering position over the hole 21.

Figure 3:
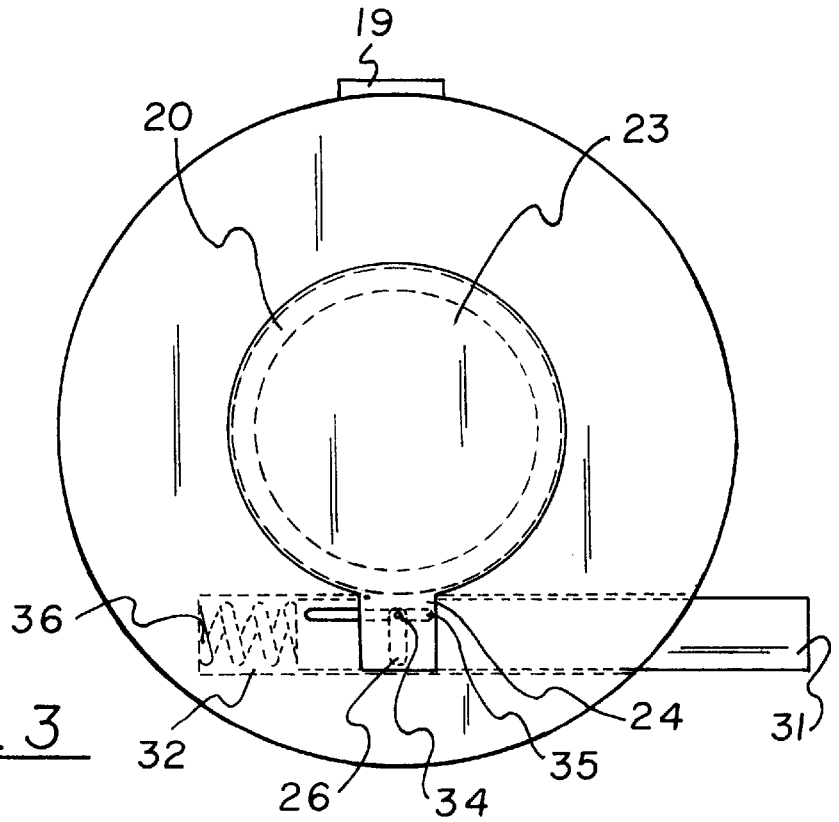
FIG. 3 is a top view of the cap with the disk in a cover position.

In use, and referring to FIGS. 3 and 4, it is seen that the spring biases the actuating tab to an outward position and the disk member to a position such that the door 23 is disposed over the hole. Therefore material cannot be dispensed through the hole. To dispense material, a person pushes the actuating tab inward using a finger or thumb, against the bias of the spring. The projection 34 moves with the tab along the slot 35, and since the projection is disposed within the track 26, the disk member is caused to pivot about the shaft 25. When the tab is pushed inward a sufficient distance, the door is moved out of the way to completely uncover the hole and permit material to be dispensed therefrom.

Figure 7:
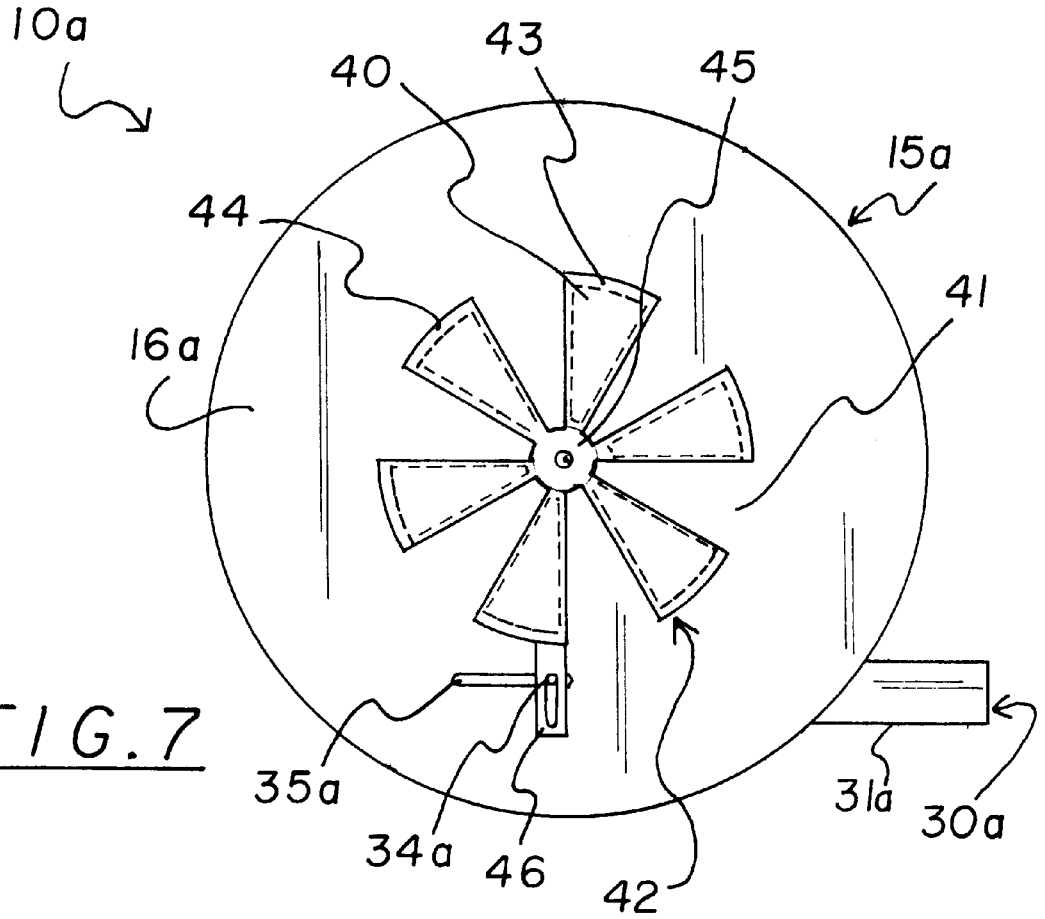
FIG. 7 is a view similar to FIG. 1, but showing an alternate pivoting disk.
Figure 8:
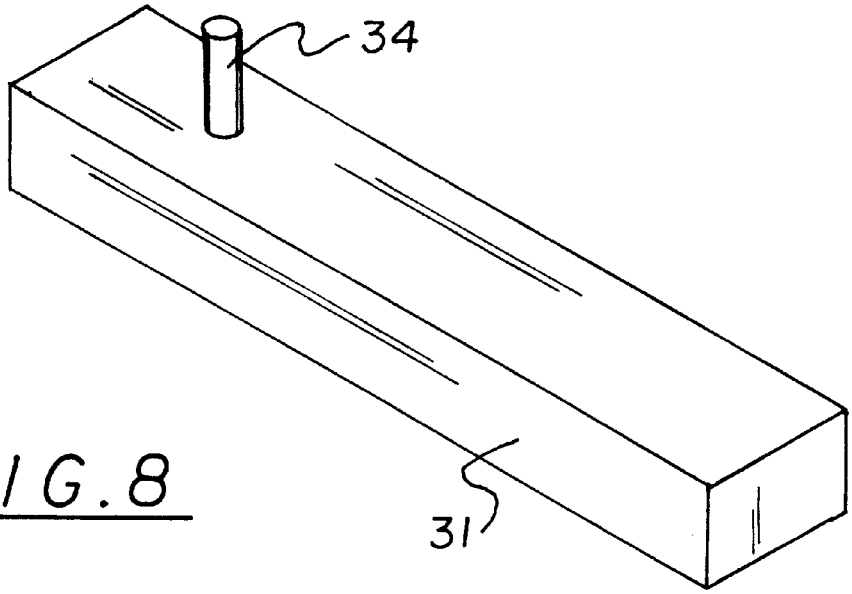
FIG. 8 is a perspective view of the actuating tab.

FIG. 7 illustrates an alternate cap 10*a* in which the cap member 15*a*, actuating means 30*a*, and linear slot 35*a* are similar to the corresponding features in the cap 10. The cap 10*a* differs in that the top wall 16*a* includes a plurality of circumferentially spaced, wedge shaped holes 40 (illustrated in dashed lines in FIG. 7) with solid regions 41 therebetween, such that the array of holes and solid regions are disposed in a circle. The solid regions meet at the center of the circle to define a central solid region. The disk member in this embodiment comprises a planar, circular disk member 42 having a corresponding plurality of apertures 43 separated by solid regions 44. The solid regions 44 meet at the center of the circle, above the center solid region of the top wall, to define a center solid region 45. A pivot shaft (not illustrated) extends from the center solid region 45 to the center solid region of the top wall in order to pivotally attach the disk member 42 to the top wall 16*a*.

As illustrated, the solid regions 44 normally cover the holes 40 while the apertures 43 are aligned with the solid regions 41 of the top wall. Therefore material cannot be dispensed through the holes 40. The disk member 42 must be pivoted such that the holes 40 and the apertures 43 are aligned before material can be dispensed. To accomplish such pivoting, a flange 46 extends from the side of the disk member 42. As stated previously, the actuating means 30*a* is similar to the actuating means 30 and includes a spring biased tab 31*a* and a projection 34*a* extending through a linear slot 35*a* in the top wall. In this embodiment, the projection 34*a* is connected to the flange 46 by disposing the projection 34*a* through a slot or track 47 provided in the flange 46, or by integrally forming the projection and flange or by suitable mechanical fastening means, such that when the tab 31*a* is pressed inward, the projection 34*a* is caused to move along the slot 35*a*, thus moving the flange 46. The disk member 42 thus pivots about the axis of the shaft 45 to align the holes and apertures, thus permitting material to be dispensed through the holes. The projection 34*a* should be made slightly flexible to accommodate the slight arcuate motion of the flange 46 during its pivoting movement. As with the first embodiment, the spring will bias the tab 31*a* outward when it is released, thus pivoting the disk member 42 to the cover position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A snap-on cap for a container which contains a material to be dispensed, comprising:

a cap member including a planar top wall and a collar depending from the top wall adapted to releasably engage an upper periphery of a container, the planar top wall including at least one dispensing hole, wherein a lower peripheral edge of the collar includes an inwardly extending peripheral ridge formed thereon;

a planar disk member pivotally attached to the top wall for pivoting movement in a plane parallel thereto between a closed position wherein said at least one hole is covered by said disk member and an open position wherein said at least one hole is uncovered;

mechanical actuation means operatively engaged with the disk member for causing pivoting movement of the disk member between the closed and open positions;

containment means extending from said top wall in the same direction as said collar and parallel thereto, said containment means surrounding said at least one dispensing hole when the cap is attached to the container, wherein the material to be dispensed travels through the containment means before reaching the dispensing hole;

said containment means comprises a resilient, cylindrical tube with a height equal to that of the collar;

said planar disk member comprises a substantially circular door having an arm extending therefrom, said disk member having a pivot shaft engaged therewith for pivotally attaching the arm to the top wall, and said actuation means being engaged with said arm;

said mechanical actuation means comprises an actuating tab slidably supported within a tab housing of the cap member and extending through the collar, said actuating tab being operatively connected with the arm, wherein the tab housing has a closed end between the tube and the collar of the cap member and an open end formed in the collar such that the actuating tab slides along a line offset from a center of the cap member and in coplanar relationship therewith;

a spring engaged with the actuating tab to bias the actuating tab to an outward position relative to the collar which simultaneously moves the disk member to the closed position; and said arm further includes a track formed therein, and said actuating tab includes a projection extending therefrom which engages within the track for operatively connecting the tab and the arm.

2. The cap of claim 1, said top wall includes a plurality of said holes circumferentially spaced thereabout.

3. The cap of claim 2, said planar disk member further comprises a plurality of circumferentially spaced apertures in the substantially circular door corresponding in number to said plurality of holes and a solid region defined between each adjacent pair of said apertures, said solid regions covering said holes when said door is in the closed position, and said holes and said apertures being aligned when said door is in the open position.

4. The cap of claim 1, said pivot shaft extends from the arm adjacent to one of the side edges thereof at an inboard extent thereof.

5. A snap-on cap for a container which contains a material to be dispensed, comprising:

a cap member including a planar top wall and a collar depending from the top wall adapted to releasably engage an upper periphery of a container, the planar top wall including at least one dispensing hole, wherein a lower peripheral edge of the collar includes an inwardly extending peripheral ridge formed thereon;

a planar disk member pivotally attached to the top wall for pivoting movement in a plane parallel thereto between a closed position wherein said at least one hole is covered by said disk member and an open position wherein said at least one hole is uncovered;

mechanical actuation means operatively engaged with the disk member for causing pivoting movement of the disk member between the closed and open positions;

containment means extending from said top wall in the same direction as said collar and parallel thereto, said containment means surrounding said at least one dispensing hole such that when the cap is attached to the container, wherein the material to be dispensed travels through the containment means before reaching the dispensing hole;

said containment means comprises a resilient, cylindrical tube with a height equal to that of the collar;

said planar disk member comprises a substantially circular door having an arm coupled to the disk member, said arm having a flexible pivot shaft engaged therewith for pivotally attaching the arm to the top wall, and said actuation means being engaged with said arm;

said mechanical actuation means comprises an actuating tab slidably supported within a tab housing of the cap member and extending through the collar, said actuating tab being operatively connected with the arm, wherein the tab housing has a closed end between the tube and the collar of the cap member and an open end formed in the collar such that the actuating tab slides along a line offset from a center of the cap member and in coplanar relationship therewith;

a coil spring engaged with the actuating tab to bias the actuating tab to an outward position relative to the collar which simultaneously moves the disk member to the closed position;

said arm further includes a track formed therein, and said actuating tab includes a projection extending therefrom which engages within the track for operatively connecting the tab and the arm; and said planar disk member further comprises a plurality of circumferentially spaced apertures in the substantially circular door corresponding in number to said plurality of holes and a solid region defined between each adjacent pair of said apertures, said solid regions covering said holes when said door is in the closed position, and said holes and said apertures being aligned when said door is in the open position, wherein the holes and the apertures are wedge shaped.

* * * * *